US007917999B2

(12) United States Patent
Leder et al.

(10) Patent No.: US 7,917,999 B2
(45) Date of Patent: Apr. 5, 2011

(54) APPARATUS AT A CARDING MACHINE FOR COTTON, SYNTHETIC FIBRES AND THE LIKE, WHEREIN AT LEAST ONE CARD FLAT HAVING A CARD FLAT CLOTHING IS PRESENT

(75) Inventors: Armin Leder, Moenchengladbach (DE); Hans Rosemann, Moenchengladbach (DE)

(73) Assignee: Truetzschler GmbH. & Co. KG, Moenchengladbach (DE)

( * ) Notice: Subject to any disclaimer, the term of this patent is extended or adjusted under 35 U.S.C. 154(b) by 183 days.

(21) Appl. No.: 12/327,250

(22) Filed: Dec. 3, 2008

(65) Prior Publication Data

US 2009/0151127 A1 Jun. 18, 2009

(30) Foreign Application Priority Data

Dec. 14, 2007 (DE) ..... 10 2007 060 982

(51) Int. Cl.
*D01G 15/92* (2006.01)

(52) U.S. Cl. ..... 19/114

(58) Field of Classification Search ..... 19/114
See application file for complete search history.

(56) References Cited

U.S. PATENT DOCUMENTS

| | | | | |
|---|---|---|---|---|
| 3,151,362 | A | 10/1964 | Freitag | |
| 2003/0139125 | A1* | 7/2003 | Riley | 451/357 |
| 2004/0082285 | A1* | 4/2004 | Bohler | 451/359 |
| 2005/0044667 | A1* | 3/2005 | Elsasser et al. | 19/98 |

FOREIGN PATENT DOCUMENTS

| | | | |
|---|---|---|---|
| DE | 25 44 517 | | 4/1977 |
| DE | 81 09 509 | | 8/1981 |
| DE | 31 18 444 | | 11/1982 |
| DE | 39 28 754 | A1 | 3/1991 |
| DE | 697 07 342 | | 7/2002 |
| DE | 10 2006 049 342 | A1 | 4/2008 |
| GB | 2 405 877 | A | 3/2005 |
| GB | 2 428 049 | A | 1/2007 |

OTHER PUBLICATIONS

Search Report issued in counterpart application GB 0822432.1, dated Apr. 9, 2009.

German Search Report, dated Sep. 12, 2008, issued in DE 10 2007 060 982.7.

* cited by examiner

*Primary Examiner* — Shaun R Hurley

(74) *Attorney, Agent, or Firm* — Vernable LLP; Robert Kinberg; Leigh D. Thelen

(57) ABSTRACT

In an apparatus at a carding machine for cotton, synthetic fibers and the like, wherein at least one card flat having a card flat clothing is present, the card flat clothing is attached to the card flat, and the clothing is located opposite a roller, for example the cylinder, and an attaching means is present between the card flat and the card flat clothing. In order to make possible, in simple manner, a dimensionally stable clothed card flat and simpler and faster re-clothing (clothing replacement), at least one hook-and-loop closure is present between the card flat and those regions of the card flat clothing which face the card flat.

22 Claims, 4 Drawing Sheets

APPARATUS AT A CARDING MACHINE FOR COTTON, SYNTHETIC FIBRES AND THE LIKE, WHEREIN AT LEAST ONE CARD FLAT HAVING A CARD FLAT CLOTHING IS PRESENT

CROSS REFERENCE TO RELATED APPLICATION

This application claims priority from German Patent Application No. 10 2007 060 982.7 dated Dec. 14, 2007, the entire disclosure of which is incorporated herein by reference.

BACKGROUND OF THE INVENTION

The invention relates to an apparatus at a carding machine for cotton, synthetic fibers and the like, wherein at least one card flat having a card flat clothing is present, the card flat clothing being attached to the card flat, and the clothing being located opposite a roller, for example the cylinder.

In a known apparatus (U.S. Pat. No. 3,151,362) the card flat consists of a rear part and a carrying member (carrier) having a bottom face. To the bottom face (the clothing-accommodating part), extending in the longitudinal direction thereof, there is attached an all-steel clothing or a clothing strip (flexible clothing). The all-steel clothing consists of a multiplicity of regions of sawtooth wire arranged next to one another. The clothing strip comprises a carrying element composed of a plurality of textile layers, in which there are attached a multiplicity of small wire hooks (clothing tips). Those regions of the clothings that are made of steel which are in each case located remote from the tips are associated with the card flat. The clothing strip is attached by means of two grippers (clamps, clips) over the longitudinal sides of the carrying member. One end of the grippers clamps the longitudinally oriented marginal regions of the clothing strip and the other end thereof engages in recesses in the carrying member. In practice, the grippers consist of a sheet metal strip, one longitudinal edge of which is pushed into the textile material. During installation, the textile material of the clothing strip is positively attached on the carrying member of the card flat with considerable tensioning, the grippers exerting such tensile forces that the textile material is deformed, bulging out from the bottom face, with the result that the clothing tips are also undesirably arranged facing outwards on a convexly shaped envelope curve. Unused, the card flat set produced in that manner has an accuracy of 0.05 mm in height and levelness. As a result of use, the height differences in the set are increased to about 0.2 mm. Re-sharpening the clothing on the machine improves the accuracy only insignificantly. After about 400 t of fiber material throughput, the card flat clothing is so worn that it has to be replaced. In order to disassemble the sheet metal clamps, the card flat is gripped. The positive fit is destroyed using levers and pincers. The considerable forces used in assembly and disassembly have a disadvantageous effect on the dimensional stability of the card flat. A further means of attaching carding clothings is shown in DE 25 44 517 A, wherein the carding clothing is attached to the inner face of a fixed card flat member by way of an intermediate layer in the form of a kind of foil, for example a foil that is adhesive on both sides. That proposal is disadvantageous in several respects. Because of the uniform thickness, an adhesive foil does not compensate for tolerances. When being removed, adhesive foils often tear, in which case remnants of the foil have to be painstakingly removed. It is especially disadvantageous that the forces that can be transmitted are too low. In addition it is disadvantageous that, for a strong connection, a high degree of contact pressure on the surface of the clothing tips is necessary, which adversely affects the clothing. Finally, the long-term stability of the adhesive foil is impaired by elevated machine temperatures that occur during carding.

SUMMARY OF THE INVENTION

It is an aim of the invention to provide an apparatus of the kind described at the beginning that avoids or mitigates the mentioned disadvantages and especially that makes possible, in simple manner, a dimensionally stable clothed card flat and allows simpler and faster re-clothing (clothing replacement).

The invention provides an apparatus at a carding machine in which at least one card flat having a card flat clothing is present, the card flat clothing being attached to the card flat, and the clothing being located opposite a roller, wherein at least one hook-and-loop closure is present between the card flat and those regions of the card flat clothing which face the card flat for attachment of said card flat clothing to said card flat.

The apparatus according to the invention makes possible simplified clothing mounting on the card flat for the clothing, especially clothing strip (carrier layer, and wires arranged in the desired setting configuration), that mounting additionally serving to allow damage-free replacement. For example, when the clothing is worn, the clothing strip to be replaced can be removed in simple manner and the undamaged card flat having the clothing mount according to the invention can be used for a new clothing strip. Using the hook-and-loop closure, a strong connection that can be released at any time can be established. The hook-and-loop closure therein includes two strips of the hook-and-loop closure, one of which bears the fleece and the other of which bears the counterpart hooks. When the fleece on the one hand and the hooks on the other hand are pressed face-to-face against one another, a strong connection is formed. The advantage of the hook-and-loop closure lies in the fact that the connection can be established in simple manner by means of pressing-together and can then be released in likewise simple manner by vigorously "tearing apart", it being possible for the connecting and releasing process to be repeated as often as desired. A mechanically stable, flexible connection is brought about, which is simple to operate, that is to say to open and to close, and which can be produced in large numbers at reasonable cost. In especially advantageous manner, a strip of the hook-and-loop closure is adhesively bonded directly to the clothing strip, whilst the counterpart strip is fixed to the card flat.

Advantageously, the hook-and loop closure consists of a hook web and a loop web. Preferably, the hook-and-loop closure comprises a closure layer in the form of hooks and a closure layer in the form of a fleece. In one embodiment, the hook web is attached to a carrier layer. Instead or as well, the loop web may be attached to a carrier layer. Advantageously, a first strip of a hook-and-loop closure comprises the hook closure layer and a carrier layer. Advantageously, a second strip of a hook-and-loop closure comprises the flange closure layer and a carrier layer. In one embodiment, the hook web is associated with the card flat, and the loop web with the card flat clothing. In another embodiment, the loop web is associated with the card flat, and the hook web with the card flat clothing.

Advantageously, an attaching layer is present between the first strip of the hook-and-loop closure and/or the second strip of the hook-and-loop closure and the card flat and/or the card flat clothing.

The attaching layer may be, for example, an adhesive layer. Advantageously, a web is attached to the card flat. For example, at least one web may be attached by an adhesive layer or the like. Preferably, the holding force of the hook-and-loop closure is greater than the force acting on the clothing during operation, for example the carding force, the force of a rotating cleaning roller or the like. Advantageously, the clothing is removable by opening the hook-and-loop closure. Advantageously the clothing is connected to the card flat by means of the hook-and-loop closure as attaching element.

Advantageously, the clothing is reversibly releasable from a web associated with the card flat. In one embodiment, the clothing inserted in a substrate, for example a fabric or the like, is made from wires or the like which are bent approximately into a U-shape and are so inserted that the bridge portion of the U-shaped wires is located on the rear of the substrate.

Advantageously, between the card flat and the card flat clothing a compensating layer is present, which is capable of compensating for disparate spacings between the card flat and the card flat clothing. For example, the compensating layer may be capable of compensating for disparate spacings between the rear face of the card flat and the bottom face of the card flat. The compensating layer may, instead or as well, be capable of compensating for disparate spacings between the sliding surfaces of the card flat heads and the bottom face of the card flat, and/or for disparate spacings between the sliding surfaces of the card flat heads and the circle of tips of the clothing tips, and/or for disparate spacings between the circle of tips of the clothing tips and the circle of tips of the cylinder clothing. Advantageously, the surface of the cylinder clothing is a reference surface for orientation of the card flat and the card flat clothing. Where present, the compensating layer is advantageously capable of compensating for local disparate spacings between the rear face of the clothing and the bottom face of the card flat.

In one embodiment, the card flat is part of a revolving card top. In another embodiment, the card flat is a stationary carding element. In one embodiment, a flexible clothing is present. The flexible clothing may include a carrier and clothing tips, wires, small hooks or the like. Preferably, the carrier is in strip form.

In another embodiment the clothing may consist of saw-tooth wire strips, for example an all-steel clothing.

Advantageously, the clothing is mounted on the card flat in the region of the bottom face. Advantageously, as compensating mass there is provided a plastics material, a synthetic resin, for example epoxy resin, or the like.

In a preferred embodiment the card flat is an extruded profile made from a light metal, for example aluminium. Advantageously, the extruded profile is a hollow profile. Advantageously two end head parts (card flat heads) are associated with the carrying member.

Advantageously, the carrying element (textile material) and a compensating layer are arranged in a recess in the bottom face (carrying member). Advantageously, the recess is bounded by at least two lateral ridges or the like at the longitudinal sides. Advantageously, the clothing strip is additionally fixed laterally at the lateral faces of the carrier layer by means of ridges, for example mounted on the card flat. Advantageously, joining is mechanically assisted, for example by means of metal plates which are attached to the card flat.

Advantageously, additional fixing and/or guidance of the clothing strip in the horizontal plane is provided. For example, the clothing strips may be held mechanically by means of ridges. Advantageously, two ridges are present at the longitudinal sides and/or two ridges are present at the transverse sides.

In one embodiment, there is accommodated a clothing strip to which there is additionally attached, by way of a compensating adhesive layer, a metal plate which is brought into connection with the web of the card flat, Advantageously, the vertical joining is mechanically assisted.

Advantageously, the hook-and-loop closure or the like extends in longitudinal direction of the card flat. In one embodiment, a plurality of hook-and-loop webs are present in the longitudinal direction of the card flat. In that case, the hook-and-loop webs may advantageously be arranged at a spacing from one another. Advantageously, on the rear of the card flat clothing, there is arranged a base made of steel strip, sheet metal or the like. In certain embodiments, the base may have tabs bent away at an angle at the sides or may have ridges or the like.

In one embodiment, the card flat has at least two clothing groups, each having a heel zone opposite the roller clothing.

In certain embodiments, the card flat clothing may consist of a multiplicity of all-steel clothing wires which are arranged in an axial direction relative to the clothed roller, for example the cylinder.

Preferably, at least one and preferably each of the marginal regions adjacent to the longitudinal edges is provided with tips. Preferably, the attaching means is for opening and for closing. Preferably, the hook-and-loop closure is for opening and for closing.

In one embodiment the clothing needles are arranged directly in a strip of a hook-and-loop closure (hook web or loop web).

The invention also provides an apparatus at a carding machine for cotton, synthetic fibers and the like, wherein at least one card flat having a card flat clothing is present, the card flat clothing being attached to the card flat, and the clothing being located opposite a roller, for example the cylinder, and an attaching means being present between the card flat and the card flat clothing, wherein at least one hook-and-loop closure is present between the card flat and those regions of the card flat clothing which face the card flat.

DETAILED DESCRIPTION OF CERTAIN PREFERRED EMBODIMENTS

Figure 1:
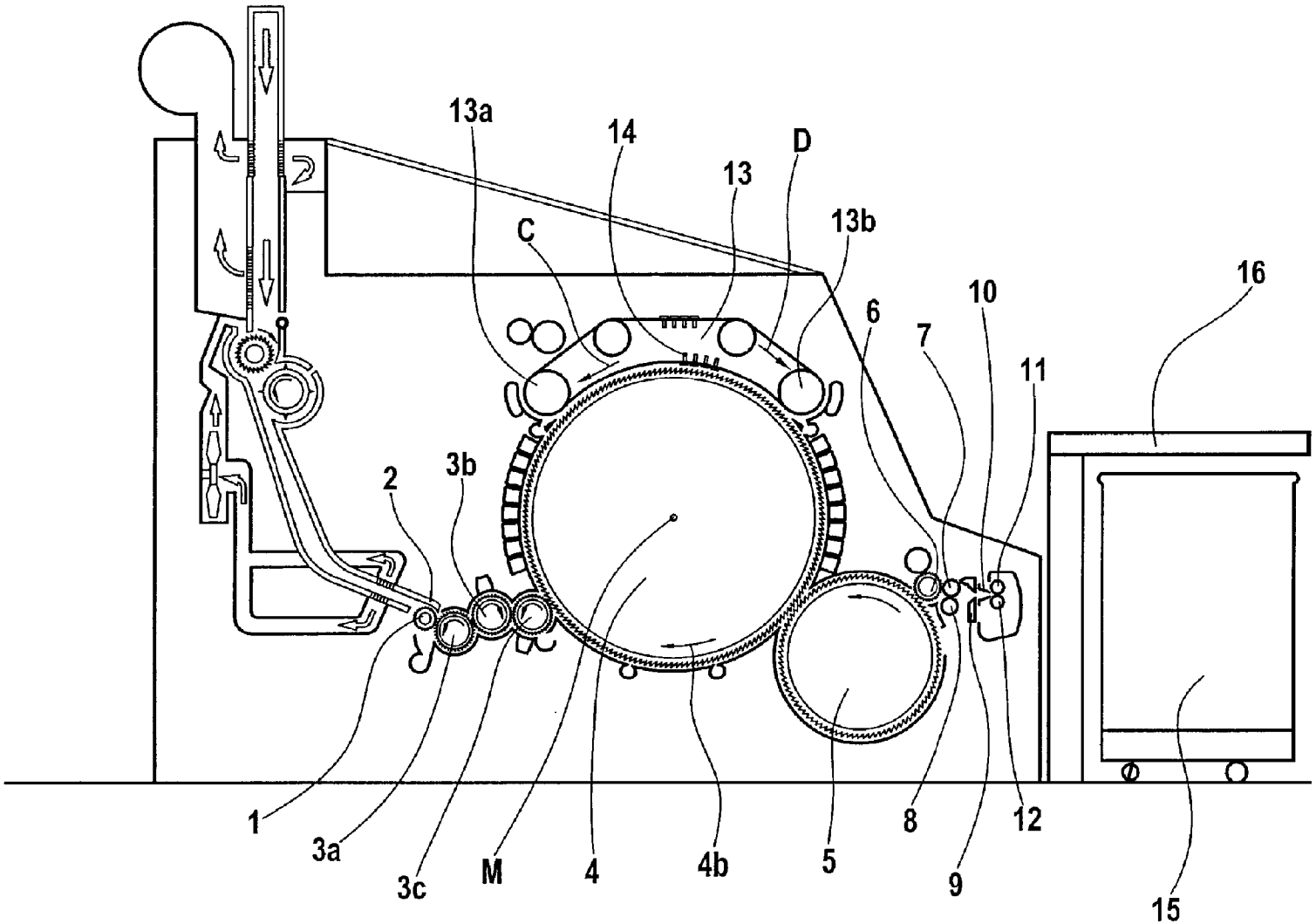
FIG. 1 is a diagrammatic side view of a carding machine having an apparatus according to the invention.

With reference to FIG. 1, a carding machine, for example a TC 07 carding machine made by Trützschler GmbH & Co KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and card flats 14, can 15 and can coiler 16. The directions of rotation of the rollers are indicated by curved arrows. Reference letter M denotes the centre (axis) of the cylinder 4. Reference numeral 4*a* denotes the clothing and reference numeral 4*b* denotes the direction of rotation of the cylinder 4. Reference letter C denotes the running direction of the revolving card top 13 in the carding location and reference letter D denotes the return transport direction of the card flats 14.

Figure 2:
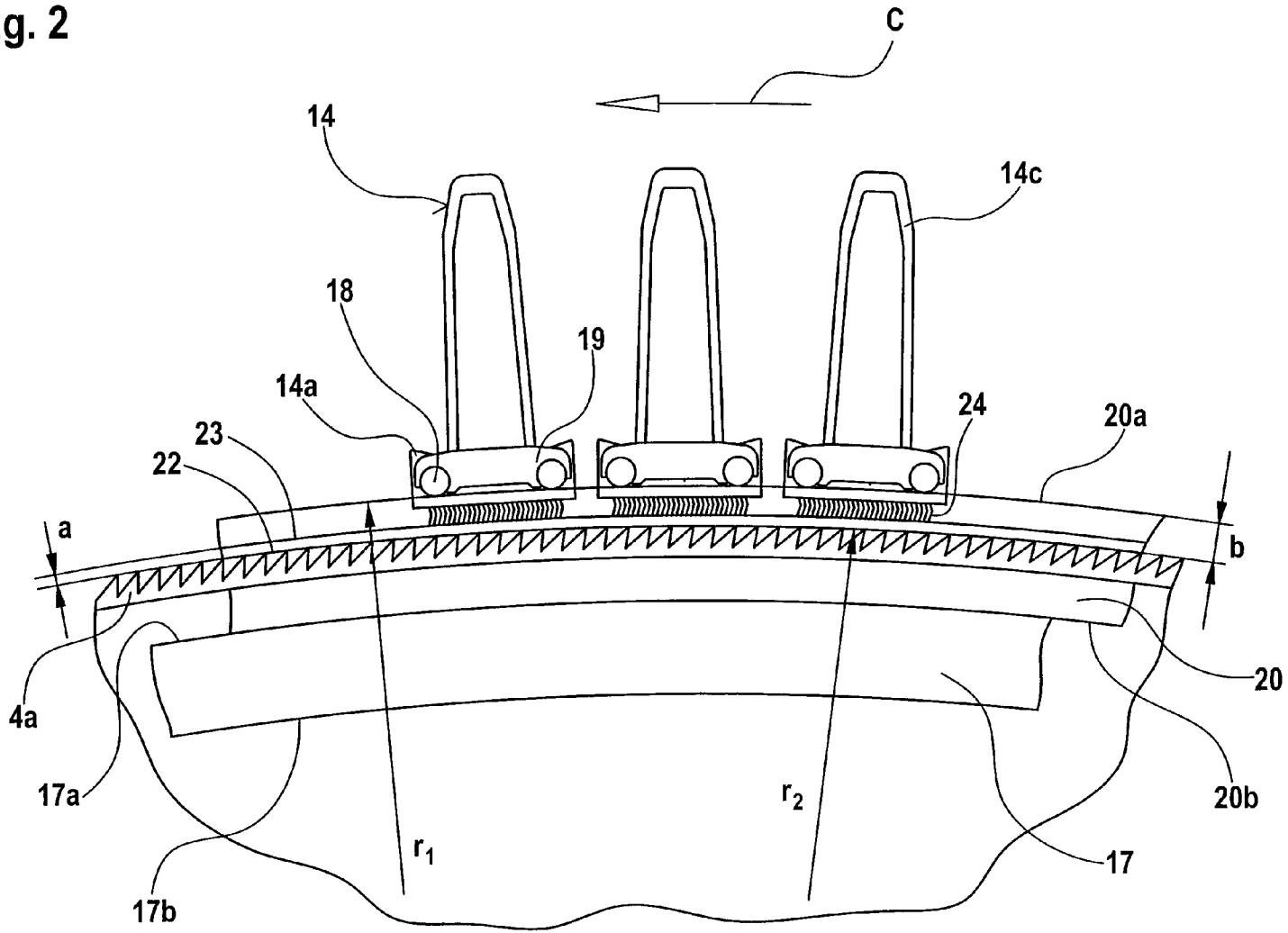
FIG. 2 shows card flats and portions of both a slideway and a flexible bend.

In a typical arrangement shown in FIG. 2, a flexible bend 17 having several adjustment screws is fixed laterally to the frame of the machine, on each side, using screws. The flexible bend 17 has a convex outer surface 17*a* and an underside 17*b*. On top of the flexible bend 17 there is a slideway 20, for example made of low-friction plastics material, which has a convex outer surface 20*a* and a concave inner surface 20*b*. The concave inner surface 20*b* rests on top of the convex outer surface 17*a*. The card flats 14, which are extruded from aluminium, have a carrying member 14*c* and a card flat bottom 14*a*. At each of the two ends of the flats there are mounted in the card flat bottom in an axial direction two steel pins 18, which slide on the convex outer surface 20*a* of the slideway 20 in the direction of arrow C. The card flat clothing 24 is mounted on the underside of the card flat bottom 14*a*. Reference numeral 23 denotes the circle of tips of the card flat clothings 24. The cylinder 4 has on its circumference a cylinder clothing 4*a*, for example a sawtooth clothing. Reference numeral 22 denotes the circle of the tips of the cylinder clothing 4*a*. The spacing between the circle of tips 23 and the circle of tips 22 is denoted by reference letter a and is, for example, 2/1000". The spacing between the convex outer surface 20*a* and the circle of tips 22 is denoted by reference letter b. The variable radius of the convex outer surface 20*a* is denoted by reference letter $r_1$ and the constant radius of the circle of tips 22 is denoted by reference letter $r_2$. The radius $r_2$ intersects the centre point M (see FIG. 1) of the cylinder 4. Reference numeral 14*c* denotes the rear of the card flat. Reference numeral 19 denotes a gripping element which engages around the card flat pins 18 and which is connected to the drive belt (not shown) for the card flats 14.

Figure 3:
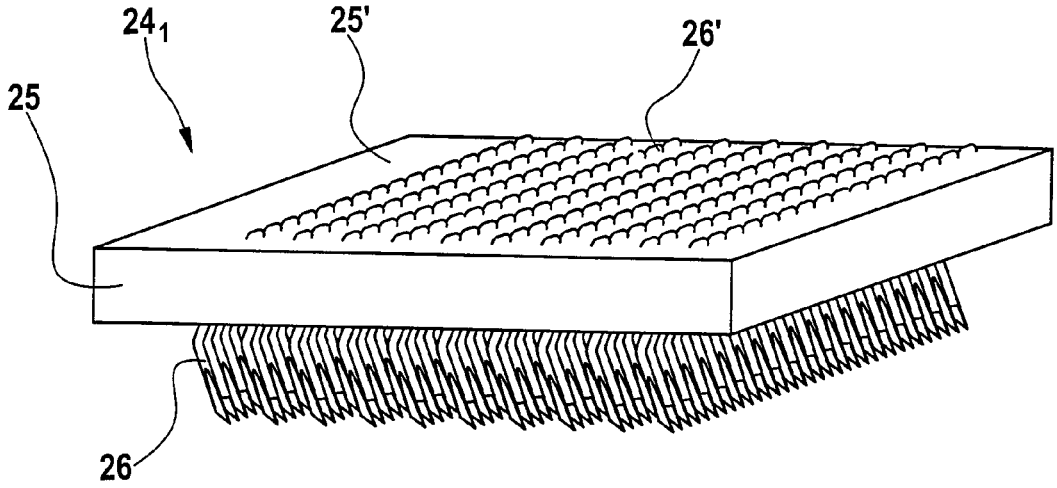
FIG. 3 is a perspective view of a clothing strip having a carrier layer and small wire hooks.

In accordance with FIG. 3, an illustrative card flat clothing $\mathbf{24}_1$ consists of clothing tips 26 (small wire hooks) and a carrying element 25 of a textile material. The small wire hooks 26 are approximately U-shaped and are fixed in the carrying element 25 by being pushed through the surface 25'. Regions 26' of the small wire hooks 26 are bent around and extend through the surface 25'. The opposite ends of the small wire hooks 26, the clothing tips, are free. The small wire hooks 26 are made from steel wire.

Figure 4:
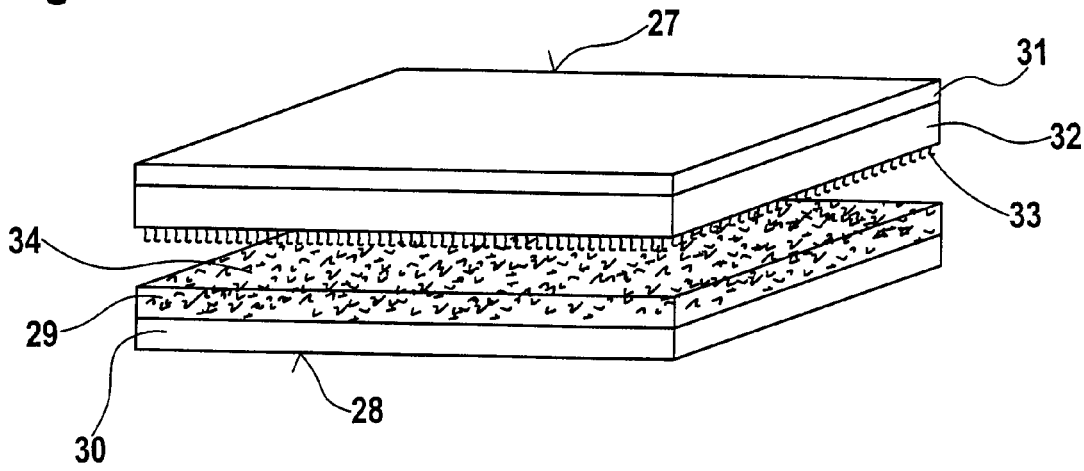
FIG. 4 is a perspective view of two hook-or-loop-comprising strips which serve to form a hook-and-loop closure.

FIG. 4 shows an upper strip 27 of an illustrative hook-and-loop closure and a lower strip 28 of that hook-and-loop closure. The lower strip 28 of that hook-and-loop closure has a fleece closure layer 29, which is arranged on a carrier layer 30. The upper strip 27 of the hook-and-loop closure also has a carrier layer 31 bearing, on its side facing the lower strip 28 of the hook-and-loop closure, a hook closure layer 32. Located on the hook closure layer are a multiplicity of individual hooks 33 whilst the fleece 34 is located on the surface of the fleece closure layer located opposite. The strip 27 of the hook-and-loop closure is attached to the lower strip 28 of the hook-and-loop closure by being pushed against it, in order to establish the desired hook-and-loop closure.

Figure 5:
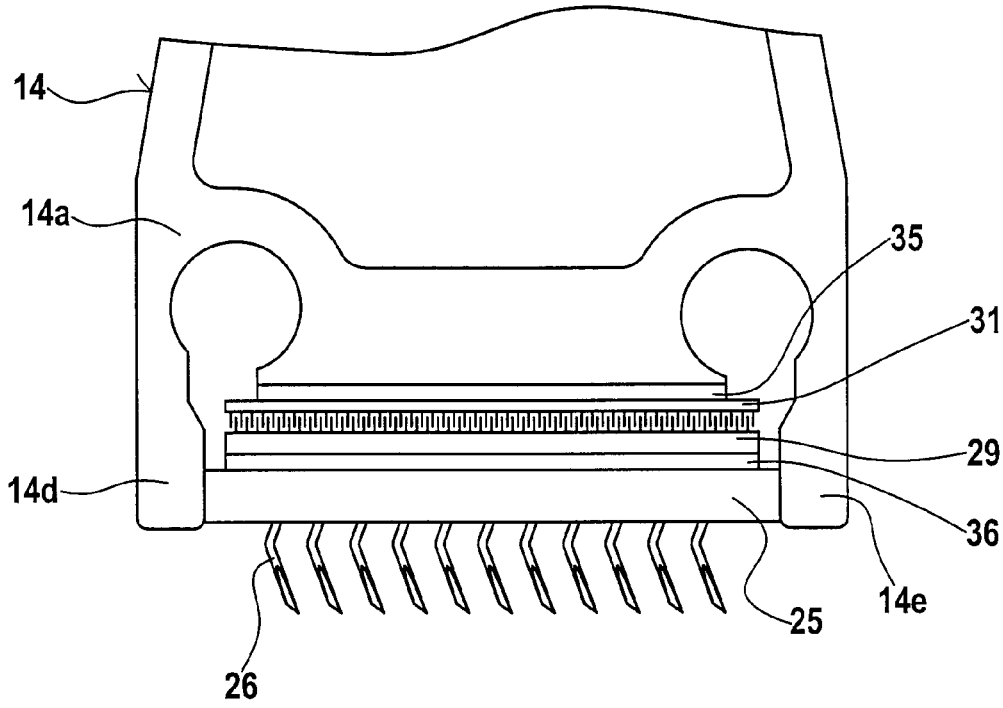
FIG. 5 is a side view of part of a card flat having a clothing strip (clothing of small wire hooks) and two strips of a hook-and-loop closure between the card flat and the clothing strip.
Figure 6:
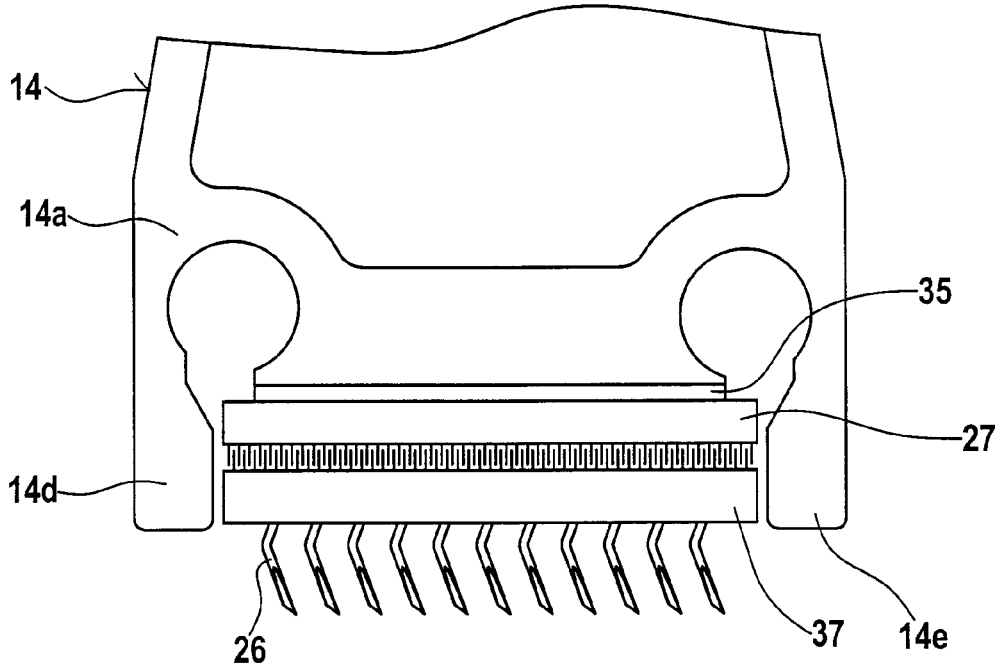
FIG. 6 is a side view of a part of a card flat having a clothing strip (clothing of small wire hooks) and a strip of a hook-and-loop closure having an anchored clothing.

In the illustrative embodiments of FIGS. 5 and 6, two ridges 14*d*, 14*e* are provided, laterally, in the longitudinal direction, on the card flat bottom 14*a* so that a recess is present in the region of the bottom face of the card flat bottom 14*a*, by means of which the card flat clothing 24 is held, protected and embedded. The upper strip 27 of the hook-and-loop closure is arranged in the upper region of the recess, the carrier layer 31 of which strip is fixed, by means of an adhesive layer 35, to the bottom face of the card flat bottom 14*a*.

In the embodiment of FIG. 5, the carrying element 25 of the card flat clothing strip 24 is arranged in the lower region of the recess; attached to that face of the carrying element 25 which is remote from the small wire hooks 26, by means of an adhesive layer 36, is the carrier layer 29 of the lower strip 28 of the hook-and-loop closure.

In the embodiment of FIG. 6, there is provided a card flat strip 37 in which the lower strip of the hook-and-loop closure has been integrated into the carrying element. The clothing tips 26 (needles) are as a result directly anchored to the lower strip of the hook-and-loop closure. A strip of a hook-and-loop closure that has a clothing is provided.

As a result of the apparatus according to the invention, the card flat clothing is held by the hook-and-loop closure so firmly that forces exerted in use on the card flat clothing 24 by the carding machine are not capable of detaching the card flat clothing 24 from the hook-and-loop closure. The card flat clothing can be separated and removed from the recess, for example when the small clothing hooks 26 are subjected to wear, damage or the like. Separation can be carried out by means of a suitable tool with which the holding force is overcome. Separation can also be carried out in use, whilst the carding machine is running, during return transport of the card flats 14 (see FIG. 1). Removal of the lower strip 28 of the hook-and-loop closure from the upper strip of the hook-and-loop closure is performed in especially simple manner by peeling or tearing off in the longitudinal direction of the card flat.

Although the foregoing invention has been described in detail by way of illustration and example for purposes of understanding, it will be obvious that changes and modifications may be practised within the scope of the appended claims.

What we claim is:

1. An apparatus at a carding machine, comprising: a card flat; a card flat clothing attached to the card flat and located opposite a roller; and at least one hook-and-loop closure positioned between the card flat and regions of the card flat clothing which face the card flat, the hook-and-loop closure attaching said card flat clothing to said card flat, further comprising a compensating positioned between the card flat and the card flat clothing, wherein the compensating layer comprises a plastic material or synthetic resin that compensates for disparate spacings between the card flat and the card flat clothing.

2. An apparatus according to claim 1, wherein the hook-and-loop closure comprises a closure layer in the form of a hook web and a closure layer in the form of a fleece.

3. An apparatus according to claim 2, further comprising a carrier layer to which the hook web and/or the fleece is attached.

4. An apparatus according to claim 1, wherein the hook-and-loop closure comprises a hook web associated with the card flat, and a loop web associated with the card flat clothing.

5. An apparatus according to claim 1, wherein the hook-and-loop closure comprises a loop web associated with the card flat, and a hook web associated with the card flat clothing.

6. An apparatus according to claim 1, further comprising an adhesive layer positioned between a first strip of the hook-and-loop closure and the card flat and/or between a second strip of the hook-and-loop closure and the card flat clothing.

7. An apparatus according to claim 1, wherein a holding force of the hook-and-loop closure is greater than forces acting on the clothing during use.

8. An apparatus according to claim 1, wherein the card flat clothing is removable by opening the hook-and-loop closure.

9. An apparatus according to claim 1, wherein the card flat clothing is connected to the card flat by means of the hook-and-loop closure as an attaching element.

10. An apparatus according to claim 1, further comprising a web associated with the card flat, wherein the card flat clothing is reversibly releasable from the web.

11. An apparatus according to claim 1, further comprising wires, wherein the card flat clothing comprises a substrate, and the wires are inserted into the substrate, and wherein the wires are bent approximately into a U-shape and are inserted so that a bridge portion of the U-shaped wires is located on the rear of the substrate.

12. An apparatus according to claim 1, wherein the roller includes a cylinder clothing having a reference surface for orientation of the card flat and the card flat clothing.

13. An apparatus according to claim 1, wherein the card flat clothing is flexible and includes a carrier in strip form and clothing tips, wires or small hooks associated with the carrier.

14. An apparatus according to claim 1, wherein the card flat clothing comprises sawtooth wire strips.

15. An apparatus according to claim 1, further comprising a plastic material or a synthetic resin positioned between the card flat and card flat clothing as a compensating mass.

16. An apparatus according to claim 1, wherein the card flat has a bottom face including a recess, the apparatus further comprising a carrying element of the card flat clothing and a compensating layer arranged in the recess.

17. An apparatus according to claim 16, wherein the recess is bounded by at least two lateral ridges at longitudinal sides of the card flat, and wherein the card flat clothing is fixed laterally at the lateral faces of the carrying element by the at least two lateral ridges.

18. An apparatus according to claim 1, further comprising at least one additional mechanical fixing device that assists in fixing the card flat clothing to the card flat.

19. An apparatus according to claim 1, wherein the hook-and-loop closure extends in the longitudinal direction of the card flat.

20. An apparatus according to claim 1, further comprising a plurality of hook-and-loop webs in the longitudinal direction of the card flat.

21. An apparatus according to claim 1, wherein the card flat has at least two clothing groups, each having a heel zone opposite the roller clothing.

22. An apparatus according to claim 1, further comprising wires, wherein the wires are arranged directly in a strip of the at least one hook-and-loop closure.

* * * * *